US008646890B1

(12) United States Patent
Lu et al.

(10) Patent No.: US 8,646,890 B1
(45) Date of Patent: Feb. 11, 2014

(54) OPENING AND CLOSING STRUCTURE OF INK CARTRIDGE

(71) Applicant: Jetbest Corporation, Hsinchu (TW)

(72) Inventors: Yi-Ching Lu, Hsinchu (TW); Ming-Chung Peng, Hsinchu (TW); Yun-Hsuan Chen, Hsinchu (TW)

(73) Assignee: Jetbest Corporation, Hsinchu (TW)

( * ) Notice: Subject to any disclaimer, the term of this patent is extended or adjusted under 35 U.S.C. 154(b) by 0 days.

(21) Appl. No.: 13/784,516

(22) Filed: Mar. 4, 2013

(30) Foreign Application Priority Data

Feb. 8, 2013 (TW) ..... 102105096 A

(51) Int. Cl.
*B41J 2/175* (2006.01)

(52) U.S. Cl.
USPC ..... 347/86

(58) Field of Classification Search
USPC ..... 347/84–86
See application file for complete search history.

(56) References Cited

U.S. PATENT DOCUMENTS

| | | | | |
|---|---|---|---|---|
| 6,227,663 | B1 * | 5/2001 | Santhanam et al. | 347/86 |
| 2010/0328406 | A1 * | 12/2010 | Inamura et al. | 347/86 |
| 2011/0063386 | A1 * | 3/2011 | Petranek et al. | 347/86 |

* cited by examiner

*Primary Examiner* — Kristal Feggins
(74) *Attorney, Agent, or Firm* — Rabin & Berdo, P.C.

(57) ABSTRACT

An opening and closing structure for ink cartridge, the ink cartridge includes a cartridge body and a lid, engaged to form a container to house a replaceable ink bag. Each of the two corresponding sides of the lid where the lid and cartridge body engage is disposed with at least a protruding hook element. Each of the two corresponding long side walls of the cartridge body is disposed with at least a latch unit. The latch unit includes a trench and a resilient latch element. As such, the lid can be easily engaged to and disengaged from the cartridge body for replacing the ink bag.

7 Claims, 8 Drawing Sheets

OPENING AND CLOSING STRUCTURE OF INK CARTRIDGE

FIELD OF THE INVENTION

The present invention generally relates to a technical field of reusable ink cartridge, and more specifically to an opening and closing structure of ink cartridge to make replacing ink cartridge convenient.

BACKGROUND OF THE INVENTION

The commercial ink cartridge for printer usually has a capacity of 400-600 ml. For spatial efficiency, the ink cartridge is mainly designed to shape as a long rectangular body, with the length/width ratio as high as 6 and more. A collapsible ink bag is disposed inside the cartridge to contain the ink for supplying ink when printing. Because of the amount of ink in the ink bag, the ink bag must be fixed inside the cartridge to prevent from the shaking or sliding of the ink bag inside cartridge during transportation. Hence, the surface of the ink bag is often partially glued to the inner wall of the cartridge. For replaceable ink cartridge, the entire cartridge is discarded when the ink is used up, which results in higher cost, waste of resource and additional pollution.

It is therefore desirable to devise a reusable ink bag to replace the known ink bag glued to the inside of the cartridge. Also, the structure of the cartridge must be redesigned to allow repeated opening and closing of the ink cartridge when replacing the ink bag. The conventional ink cartridge with large capacity is designed as a disposable product for one-time use. Thus, no reopening and reclosing of the cartridge is necessary after the lid and the cartridge body of the ink cartridge are closed. Therefore, the known cartridge usually has a structure of one-way engagement, i.e., once the lid and the cartridge body of the ink cartridge are engaged and closed, the brutal reopening of the cartridge is prone to damage some of the elements; otherwise, a specific auxiliary tool is required for reopening the cartridge, for example, by using screwdriver to disengage the lid and the cartridge body or inserting a tool into specific hole to press down a certain engagement part to disengage the lid and the cartridge body. All the above alternatives are inconvenient to the user.

SUMMARY OF THE INVENTION

The primary object of the present invention is to provide an opening and closing structure of ink cartridge, having a mechanism for reopening and reclosing the ink cartridge without auxiliary tool so that the lid and the cartridge body of the ink cartridge can be engaged and disengaged conveniently to facilitate replacement of ink bag inside the cartridge.

To achieve the above object, the ink cartridge of the present invention includes a cartridge body and a lid, engaged to form a container to house a replaceable ink bag. Each of the two corresponding sides of the lid where the lid and cartridge body engage is disposed with at least a protruding hook element. Each of the two corresponding long side walls of the cartridge body is disposed with at least a latch unit. The latch unit includes a trench and a resilient latch element. When assembled, the protruding hook element is inserted into the trench of the cartridge body. The resilient latch element presses against the edge of the protruding hook element to fix the respective position of the two elements. To disengage the lid form the cartridge body, move the lid laterally so that the protruding hook element moves along the trench to disengage from the resilient latch element. As such, the lid can be lifted to disengage from the cartridge body.

With the above design, to engage the lid to the cartridge body, the lid is placed and pressed onto the top of the cartridge body from a predefined angle so that the lid is engaged to the latch unit of the cartridge body. To replace the ink bag, the lid is moved laterally in a short distance with respective to the cartridge body, and is lifted from the cartridge body. No additional tool is required to assist in disengaging the lid from the cartridge body. As such, the ink cartridge can be reopened and reclosed for replacing the ink bag.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
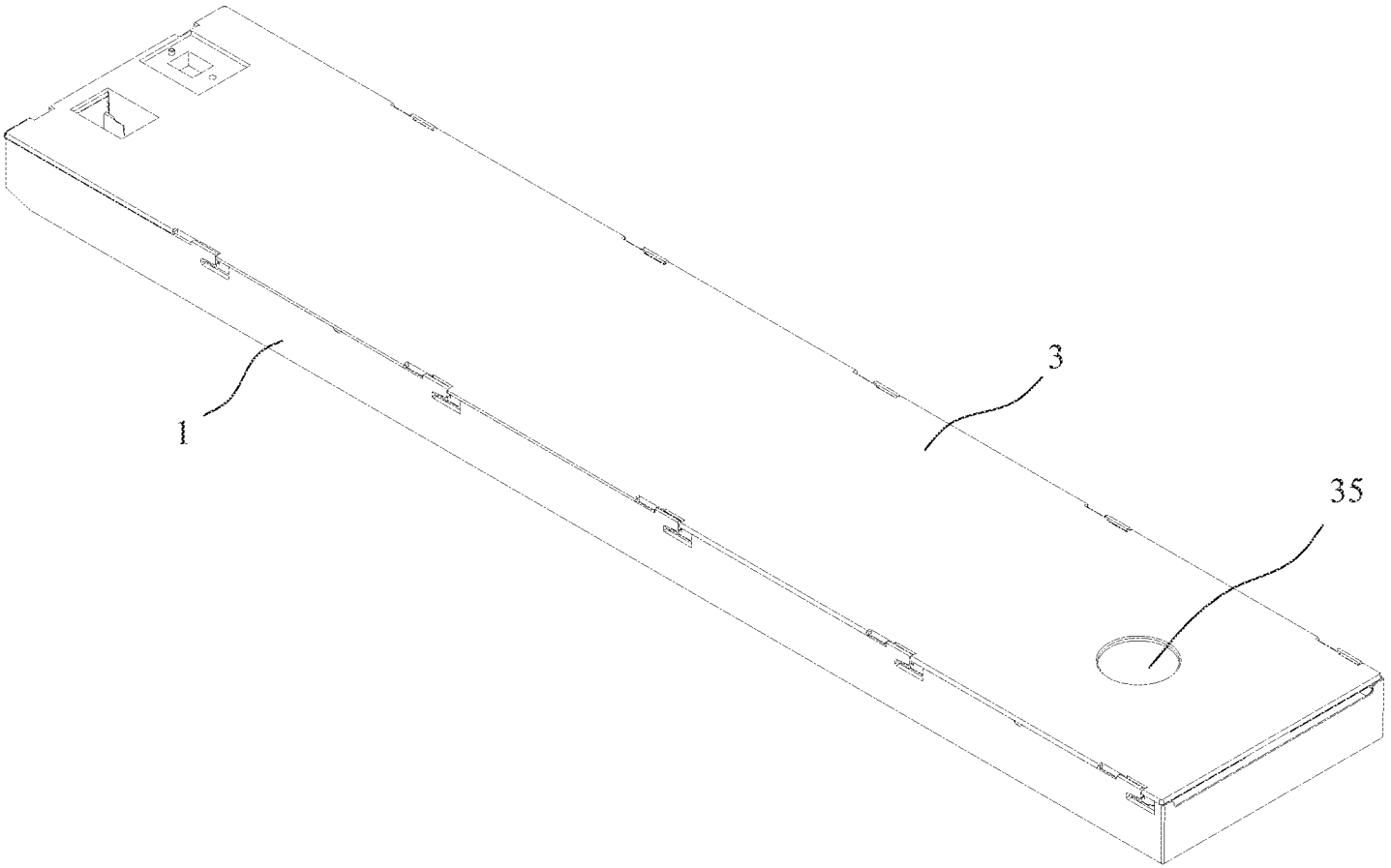
FIG. 1 shows a schematic view of the present invention.
Figure 2:
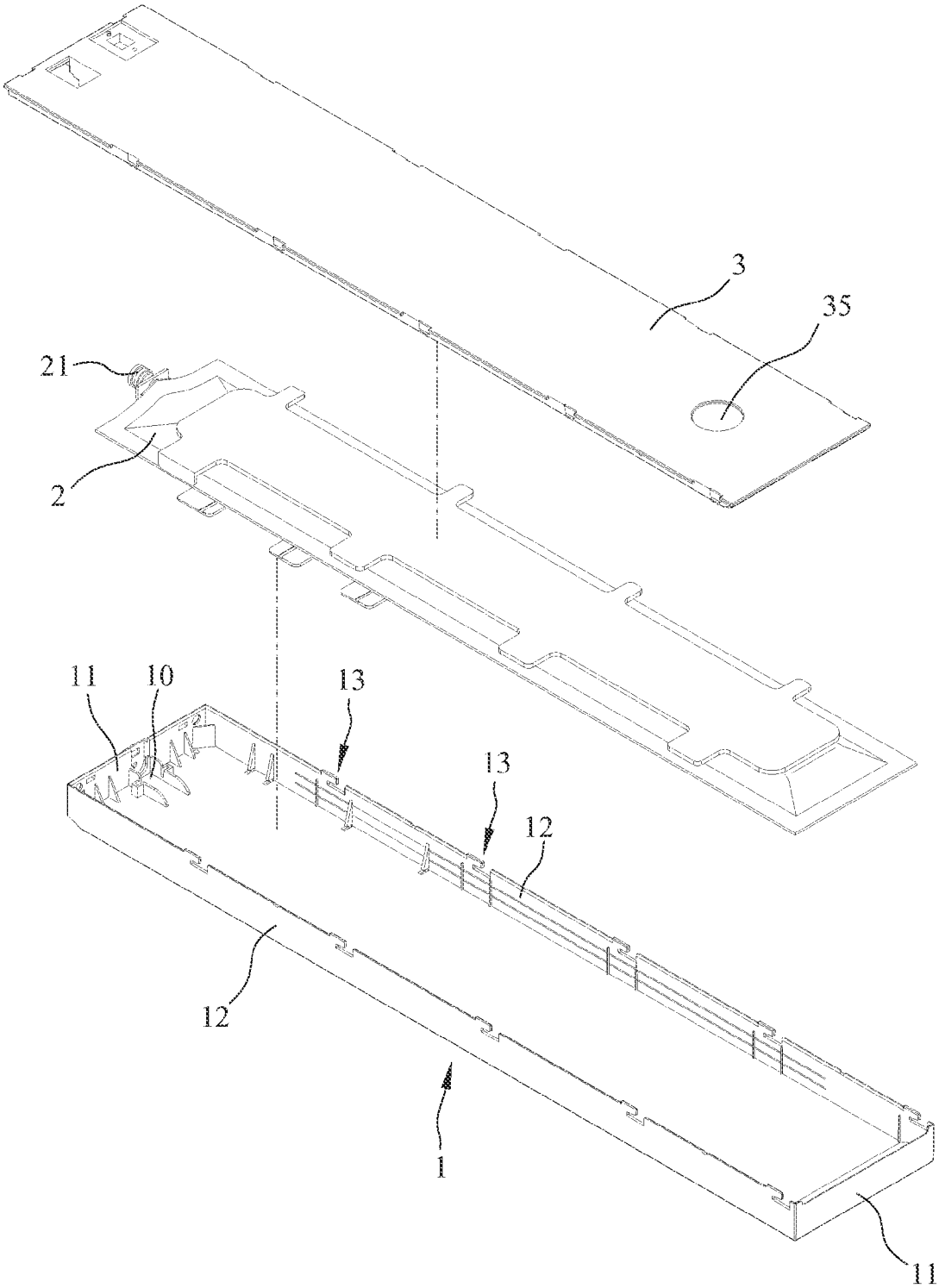
FIG. 2 shows a dissected view of the present invention in actual application.

FIG. 1 and FIG. 2 show a schematic view and a dissected view of the present invention in actual application respectively. The ink cartridge of the present invention includes at least a cartridge body 1 and a lid 3, engaged to form a container to house a replaceable ink bag 2. The shape of the container can be rectangular, but is not limited to the shape. The ink bag 2 is disposed inside the cartridge body 1 in a replaceable manner. When the ink is used up, the ink bag can be replaced. The ink bag 2 includes an ink supply connector 21 and the cartridge body 1 has a connector matching socket 10 disposed inside. The structure of the connector matching socket 10 matches the shape of the ink supply connector 21 so that the ink supply connector 21 is correctly fixed inside the cartridge body 1 when assembled. The connector matching socket 10 matches the shape of the ink bag 2, and the present invention does not impose any specific.

Figure 3A:
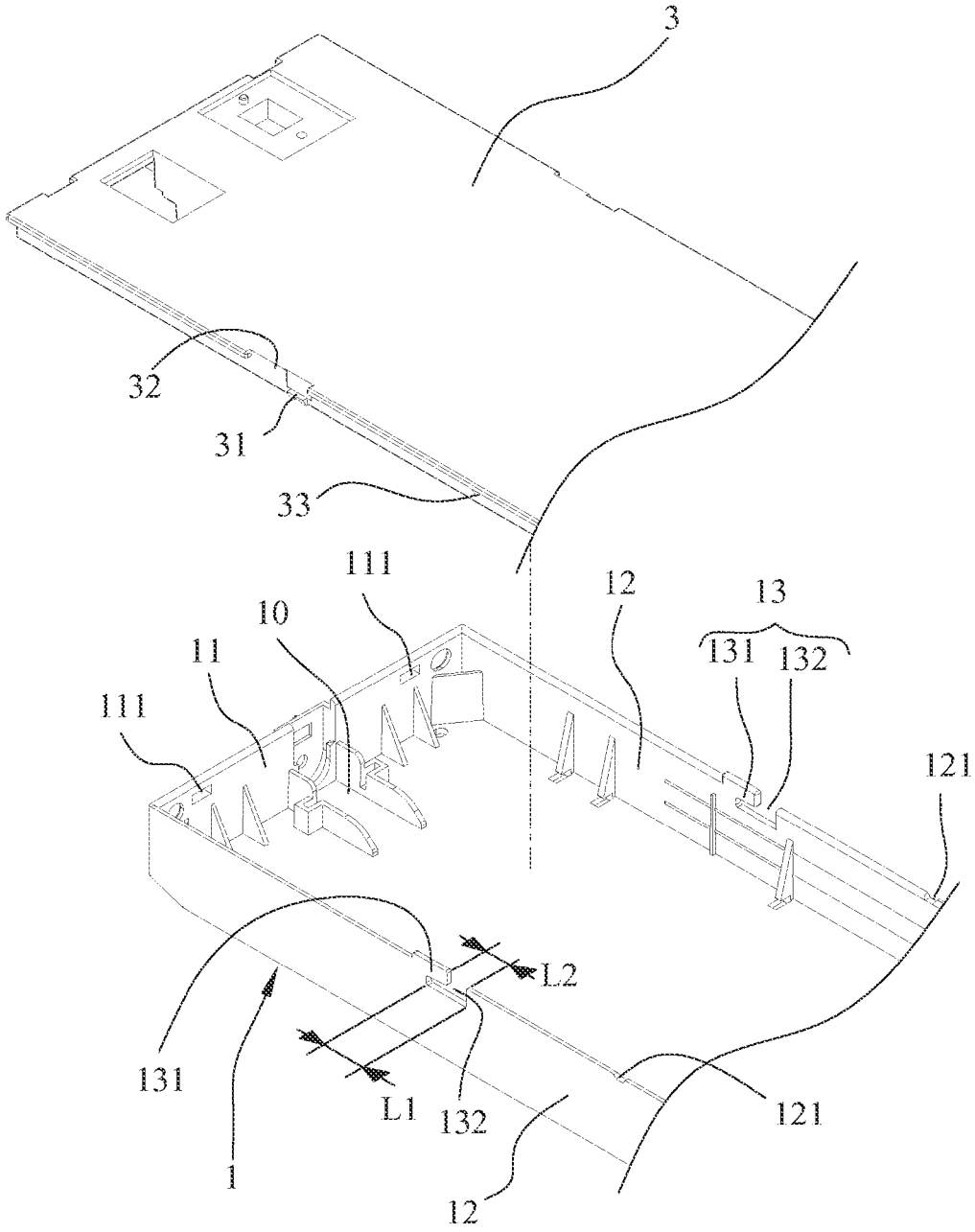
FIG. 3A shows a partial enlarged view of the lid and the cartridge body of the present invention.
Figure 3B:
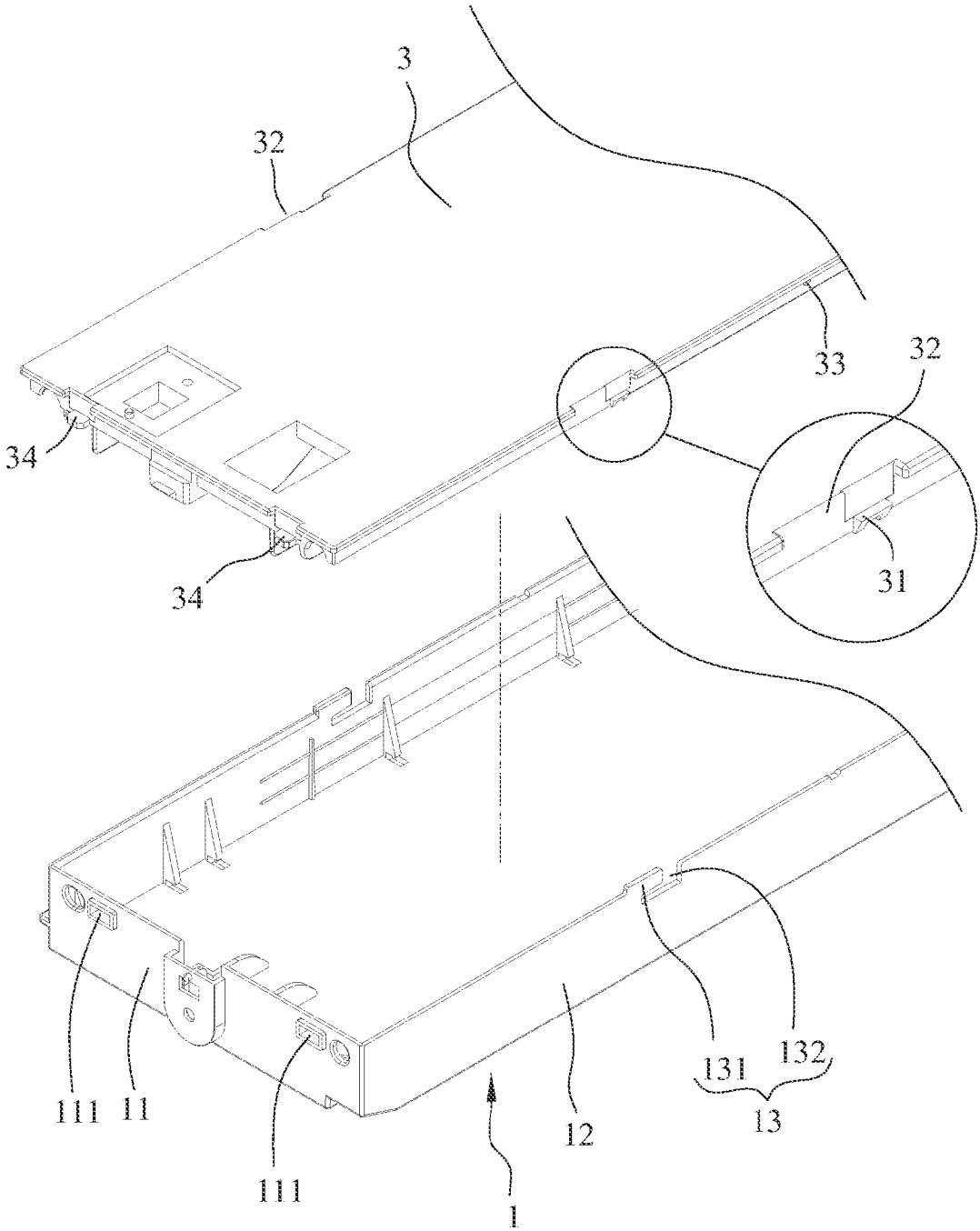
FIG. 3B shows another partial enlarged view of the lid and the cartridge body of the present invention from a different angle.

The main feature of the present invention is that the lid 3 can be fixed rapidly inside the cartridge body 1 when assembled. No additional tool is required to disengage from the cartridge body 1. As shown in FIG. 2, FIG. 3A and FIG. 3B, the cartridge body 1 is a hard-shell container having a box shape with an upward opening. The box shape is formed by two short side walls 11 and two long side walls 12. Each of the long side walls 12 of the cartridge body 1 is disposed with at least a latch unit 13. The latch unit 13 is located at the top of the long side wall 12 and includes a trench 131 and a resilient latch element 132. The resilient latch element 131 makes the trajectory of the trench 132 appear L-shape. The opening width L2 of the trench 132 is less than the trench bottom width L1. The trench bottom width L1 is equal to or greater than the distance that the lid 3 can move laterally. The plurality of trenches 132 distributed along the long side wall 12 has the same direction. The resilient latch element 131 has a height protruding above the top of the long side wall 12. The top of the long side wall 12 further includes at least a positioning trench 121 so that, when assembled, the lid 3 will not easily slide laterally. One of the short side walls 11 of the cartridge body 1 includes at least a positioning hole 111. In the present embodiment, two positioning holes 111 are disposed for fast positioning the lid 3 when assembling to shorten the assembly time.

The lid 3 has a shape corresponding to the cartridge body 1, in a form of a long rectangular plate. Each of the two long sides of the lid 3 is disposed with at least a protruding hook element 31. The location of the protruding hook element 31 corresponds to the location of the latch unit 13. The edge where the protruding hook element 31 is located on the lid 3 includes a limiting trench 32. The limiting trench 32 has a width greater than or equal to the distance that the lid 3 can move laterally on the top of the cartridge body 1. In addition, the bottom at the edge of the two sides of the lid 3 includes at least a protruding bump 33, located correspondingly to the positioning trench 121. One of the two short sides of the lid 3 further includes at least a positioning protruding block 34. When assembled, the positioning protruding block 34 is inserted into the positioning hole 111. As shown in FIG. 2, the lid 3 further includes a push hole 35, located at the side of the lid 3 with the positioning protruding block 34. To disengage the lid 3 from the cartridge body 1, the push hole 35 allows a finger to insert to contact the side wall of the lid 3 to push the lid 3 to move.

Figure 4:
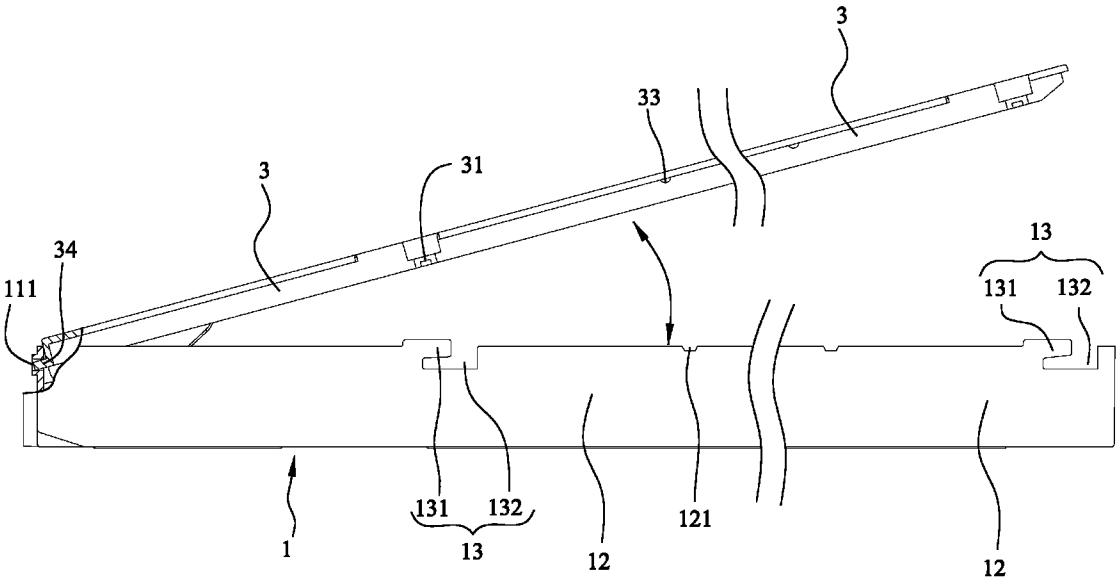
FIG. 4 shows a schematic view of the present invention before assembling the lid to the cartridge body according to the present invention.
Figure 5:
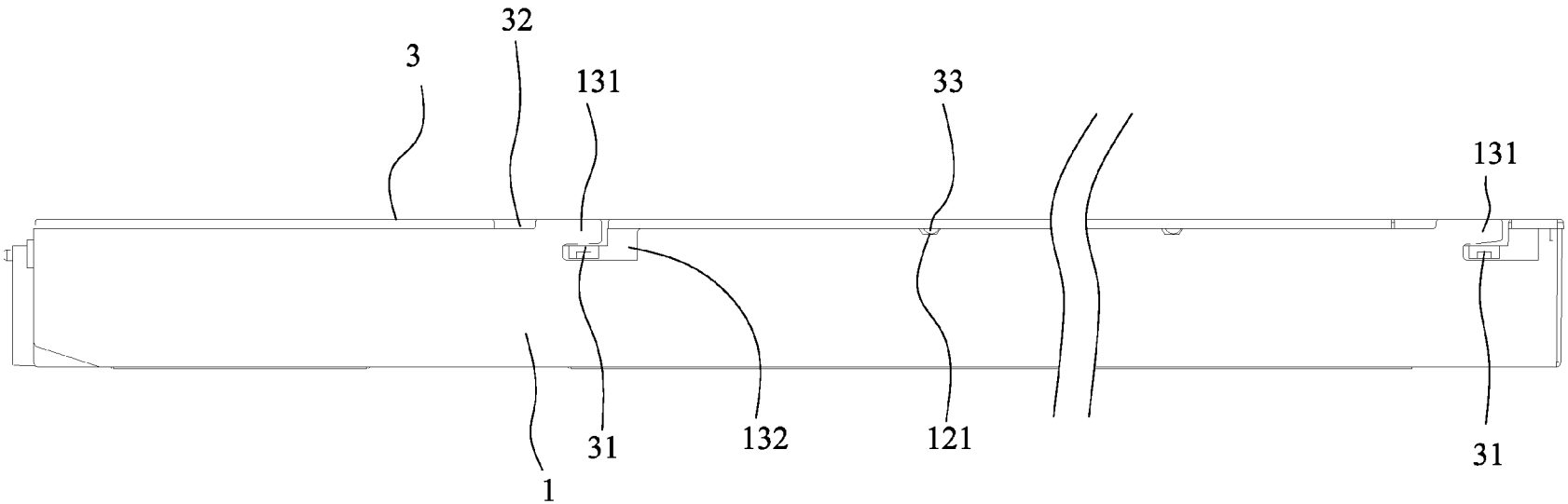
FIG. 5 shows a schematic view of the present invention after assembling the lid to the cartridge body according to the present invention.

The following describes the assembling of the lid 3 onto the cartridge body 1. As shown in FIG. 4, the positioning protruding block 34 of the lid 3 is inserted into the positioning hole 111 of the cartridge body 1, the lid 3 is flipped downwards around the positioning protruding block 34. When the protruding hook element 31 contacts the resilient latch element 131, the reversed triangular shaped protruding part of the protruding hook element 31 will push the resilient latch element 131 outwards so that the protruding hook element 31 is inserted inside the trench 132, as shown in FIG. 5. At this point, the resilient latch element 131 presses against the top edge of the protruding hook element 31 so that the lid 3 cannot move upwards. The protruding bump 33 is located inside the positioning trench 121 so that the lid 3 cannot move laterally. As such, without external force, the lid 3 is firmly fixed to the top of the cartridge body 1.

Figure 6A:
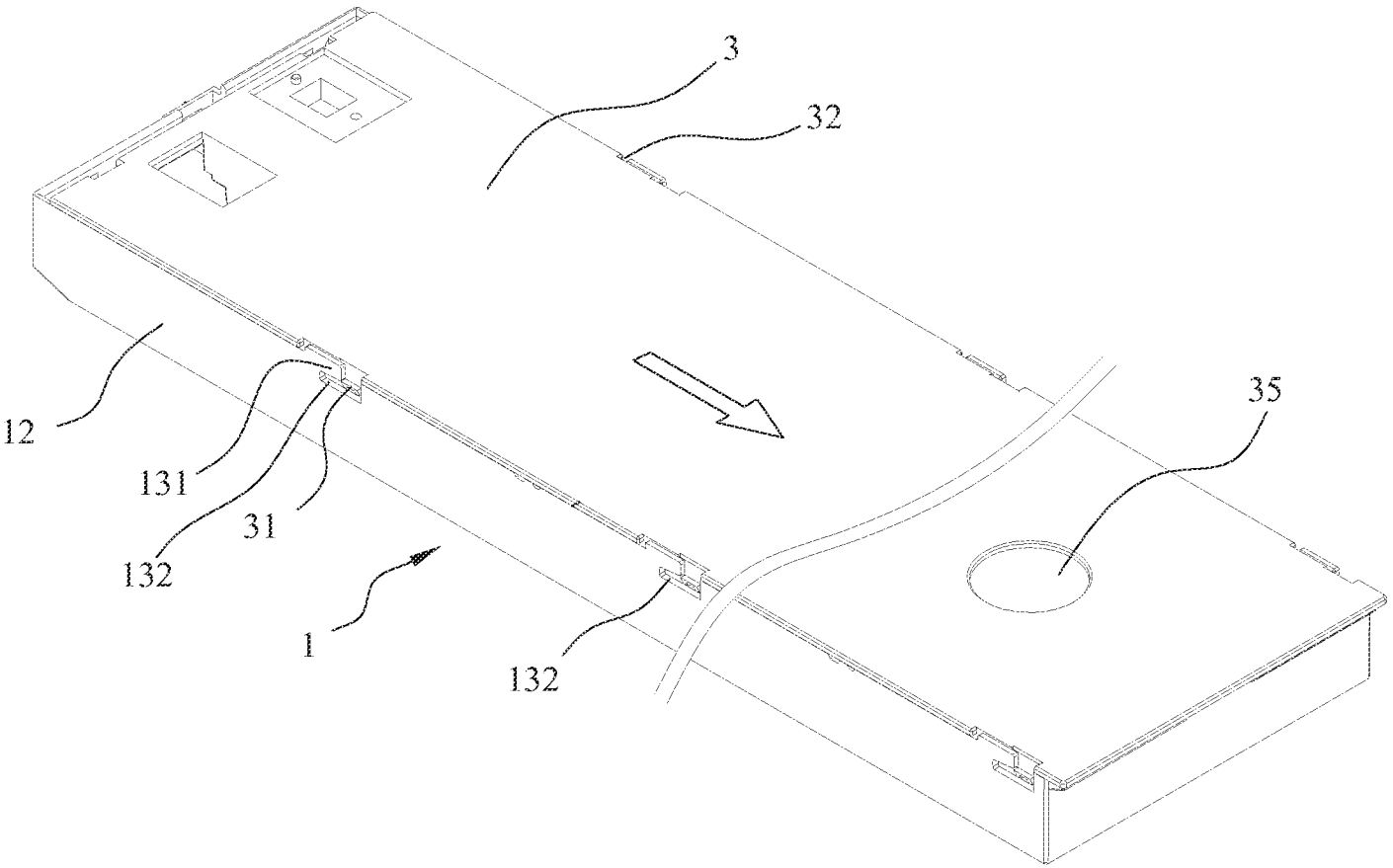
FIG. 6A shows a schematic view of the lid moving laterally on top of the cartridge body according to the present invention.
Figure 6B:
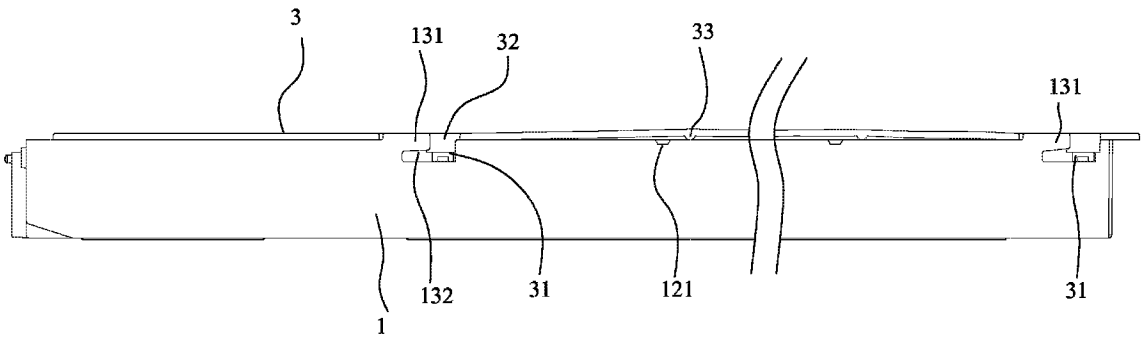
FIG. 6B shows a side view of the lid moving laterally on top of the cartridge body according to the present invention.

To disengage the lid 3 from the cartridge body 1, as shown in FIG. 6A, insert a finger into push hole 35 and push the lid 3 to move laterally so that the protruding hook element 31 moves along the trench 132 to disengage from the resilient latch element 132 and move to the opening of the trench 132, as shown in FIG. 6B. At this point, the positioning protruding block 34 is disengaged from the positioning hole 111 so that the lid 3 can be lifted to disengage from the cartridge body 1. The disengagement operation can be conducted without assistance of any tool.

In summary, with the present invention, the engagement of the lid 3 to the cartridge body 1 and the disengagement of the lid 3 from the cartridge body 1 can be performed without any tool so that the ink cartridge can be reopened and reclosed for replacing the ink bag.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An opening and closing structure of ink cartridge, the ink cartridge having a cartridge body and a lid, engaged to form a container to house a replaceable ink bag, characterized in that:

each of two corresponding sides of the lid where the lid and cartridge body engage being disposed with at least a protruding hook element; each of two corresponding long side walls of the cartridge body being disposed with at least a latch unit; the latch unit comprising a trench and a resilient latch element; when assembled, the protruding hook element being inserted into the trench of the cartridge body; the resilient latch element pressing against the edge of the protruding hook element to fix the respective position of the two elements; to disengage the lid form the cartridge body, moving the lid laterally so that the protruding hook element moving along the trench to disengage from the resilient latch element; the lid being lifted to disengage from the cartridge body.

2. The opening and closing structure of ink cartridge as claimed in claim 1, wherein the long side wall of the cartridge body comprises at least a positioning trench; the bottom at the edge of the two sides of the lid comprises at least a protruding bump; when assembled, the protruding bump is located inside the positioning trench.

3. The opening and closing structure of ink cartridge as claimed in claim 1, wherein the trench has a trajectory appearing L-shape, and the trenches distributed along the long side wall of the cartridge body have the same direction.

4. The opening and closing structure of ink cartridge as claimed in claim 1, wherein one of two short side walls of the cartridge body comprises at least a positioning hole; the corresponding side of the lid comprises at least a positioning protruding block; when assembled, the positioning protruding block is inserted into the positioning hole.

5. The opening and closing structure of ink cartridge as claimed in claim 1, wherein the lid further comprises a push hole for allowing a finger to insert to push the lid to move.

6. The opening and closing structure of ink cartridge as claimed in claim 1, wherein the edge where the protruding hook element is located on the lid comprises a limiting trench, having a width greater than or equal to the distance that the lid can move laterally on the top of the cartridge body; when assembled, the resilient latch element is located inside the limiting trench.

7. The opening and closing structure of ink cartridge as claimed in claim 1, wherein the ink bag has an ink supply connector and the cartridge body has a connector matching socket; and the connector matching socket has a shape matching the shape of the ink supply connector.

* * * * *